US009764806B2

(12) United States Patent
Dion

(10) Patent No.: US 9,764,806 B2
(45) Date of Patent: Sep. 19, 2017

(54) STANDUP PADDLE OUTRIGGER WATERCRAFT

(71) Applicant: Daniel Joseph Dion, Palm Desert, CA (US)

(72) Inventor: Daniel Joseph Dion, Palm Desert, CA (US)

(73) Assignee: Daniel Joseph Dion, Palm Desert, CA (US)

( * ) Notice: Subject to any disclaimer, the term of this patent is extended or adjusted under 35 U.S.C. 154(b) by 0 days.

(21) Appl. No.: 15/149,041

(22) Filed: May 6, 2016

(65) Prior Publication Data

US 2016/0325806 A1 Nov. 10, 2016

Related U.S. Application Data

(60) Provisional application No. 62/179,383, filed on May 6, 2015, provisional application No. 62/388,276, filed on Jan. 26, 2016.

(51) Int. Cl.
*B63H 25/38* (2006.01)
*B63B 35/79* (2006.01)

(52) U.S. Cl.
CPC ..... *B63B 35/7916* (2013.01); *B63H 25/38* (2013.01)

(58) Field of Classification Search
CPC ..... B63B 1/20; B63B 35/79; B63B 35/7906; B63B 35/7943; B63B 35/7916; B63H 25/38
USPC ..... 114/123, 283; 441/65, 74
See application file for complete search history.

(56) References Cited

U.S. PATENT DOCUMENTS 4,037,557 A * 7/1977 Arevalo ..... B63H 16/14 114/283
6,347,599 B1 * 2/2002 Hendrickson ..... B63B 35/7906 114/123
7,410,400 B2 * 8/2008 Staudinger ..... B63B 1/14 114/123

* cited by examiner

*Primary Examiner* — Lars A Olson
(74) *Attorney, Agent, or Firm* — Mintz Levin Cohn Ferris Glovsky and Popeo, P.C.

(57) ABSTRACT

A standup paddleboard outrigger includes a long, narrow, lightweight displacement hull and a pair of outrigger pontoons mounted to a bridge. The two parts disengage for easy storage and transport. The hull has a platform to stand on. Paddling with a long handled paddle propels the craft through the water. The outriggers provide lateral stability/support and actuate the rudder in order to make turns. When a person stands on the platform and shifts body weight, the rudder will rotate to the right and the craft will turn to the right. The more weight that is shifted, the greater the turning action. The responsiveness to the shift of body weight can be adjustable for personal preference either firmer or more flexible, as is the turning response of the rudder fine or coarse turning.

1 Claim, 16 Drawing Sheets

STANDUP PADDLE OUTRIGGER WATERCRAFT

CROSS REFERENCE TO RELATED APPLICATIONS

This application claims the benefit of U.S. patent application Ser. No. 62/179,383, filed on May 6, 2015 and U.S. patent application Ser. No. 62/388,276, filed on Jan. 26, 2016, which are incorporated by reference herein in their entirety.

TECHNICAL FIELD OF THE INVENTION

The present disclosure relates to personal watercraft, and more particularly to a standup paddleboard outrigger watercraft.

BACKGROUND OF THE INVENTION

For thousands of years, river, lake and coastal cultures have stood within their canoes and upon rafts to paddle in a standing position. Conceptually therefore, the idea of standing and paddling using an extended paddle is far from being a new concept. Recently, with modernized materials and designs, standup paddle boarding SUP has become significantly more popular both as casual recreation and as a competitive sport. Although SUPs have evolved over time, current designs are based on the rudimentary concept of an oversized surfboard. The wide, flat shape of a surfboard hull is limited in terms of hydrodynamic efficiency for paddling; it is based on a planing hull designed to skim across the surface of water at high speed. This speed is achieved when riding a wave but not when paddling on flat water where most paddling typically takes place.

SUP boards designed for speed sacrifice stability because they are narrow which makes them tippy. Maneuverability of a typical SUP board is limited as well; it is achieved by the use of the paddle and dependent on the skill level of the paddler. In order to maintain a straight course, a paddler must switch the paddle to the opposite side of the board every three to five strokes. Every switch requires a measure of time that can add up significantly over a long distance. In order to make a turn, the paddler is required to paddle on the outside of a turn, and sometimes even back paddle on the inside to make a sharp enough turn.

SUMMARY

This document describes a standup paddleboard outrigger SUPO personal watercraft, which can be used in the context of recreation and fitness paddling, as well as competitive racing for sport. The SUPO described herein enables a considerable improvement in efficiency, speed, stability and maneuverability over existing standup paddle watercraft.

First, the SUPO hull is narrow and designed as a displacement hull to provide the optimal hydrodynamic efficiency for speed while paddling in flat water. Secondly, it has two outrigger pontoons, one on each side, which provide lateral stability. Finally, maneuverability is achieved by pivoting the pontoons; this is achieved by the paddler shifting body weight through the feet. Accordingly, the paddler does all maneuvering by shifting body weight and there is no need to switch the paddle from side to side to maintain a straight course; a paddler can paddle on a given side for as long as they wish. When turning, for example rounding a buoy, the paddler does not have to paddle on the outside of the turn but can paddle on the inside in order to achieve greater leverage and therefore more speed. In a downwind situation the paddle can be used to support a sail since it is not needed for propulsion. A propulsion system can be attached to the craft for hands-free/paddle-free cruising.

In one aspect, a SUPO design combines the speed and maneuverability of a solo single person outrigger craft with the advantages of a SUP, such as using a longer paddle to achieve greater leverage. The SUPO has two parts, a long, narrow, lightweight displacement hull and a pair of outrigger pontoons mounted to a bridge, which is connected perpendicularly to the hull towards the rear. The two parts disengage for easy storage and transport. The hull has a platform to stand on. Paddling with a long handled paddle propels the craft through the water. The outriggers provide lateral stability/support and actuate the rudder in order to make turns. While standing on the platform and shifting body weight to the right foot, the rudder will rotate to the right and the craft will turn to the right. The more weight that is shifted, the greater the turning action. Shifting body weight to the left foot turns the craft to the left. The responsiveness to the shift of body weight is adjustable for personal preference either firmer or more flexible, as is the turning response of the rudder fine or coarse turning. The design provides for a highly stable, maneuverable, and fast self-propelled personal watercraft.

In another aspect, the pontoon bridge has a central pivot point so that the pontoons can swing forward and adjacent to the hull for easy storage and transport. Because the hull is so narrow, there is a wider platform to stand on.

The outriggers not only provide lateral stability/support, they also rotate, while maintaining a parallel relationship to each other, in order to make turns. While standing on the platform and shifting body weight to the right foot, the pontoons will rotate counterclockwise viewed from above and the craft will turn to the right. Increasing the weight that is shifted results in a sharper turn. Shifting body weight to the left foot turns the craft to the left. Maneuvering the craft is solely accomplished by shifting body weight, using a paddle for turning is not necessary.

There are at least three ways to propel the craft: paddling with a long handled paddle; sailing by attaching a sail to the paddle; and by attaching an electric motor or other propulsion system to the craft.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes a standup paddleboard outrigger watercraft, which enables a considerable improvement in efficiency, speed, stability and maneuverability over existing standup paddle watercraft.

In the following description, numerous specific details are set forth. However, it is understood that embodiments may be practiced without these specific details. In other instances, well-known materials, structures, and techniques have not been shown in detail in order not to obscure the understanding of this description.

Figure 1A:
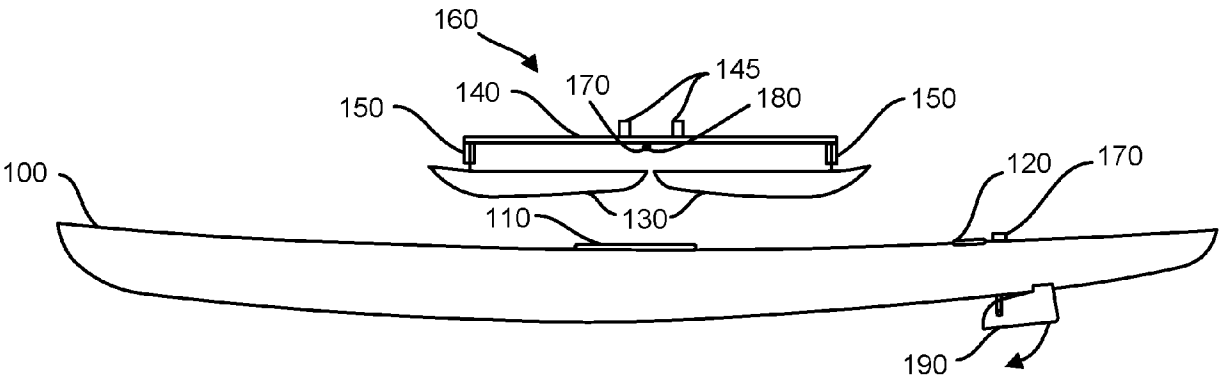
FIG. 1A shows the side view of the SUPO in the stored position with the outriggers turned parallel to the bridge and the rudder retracted upwards into the hull.

FIG. 1A illustrates a side view of a SUPO assembly 101 in a disassembled, storage position. The SUPO includes a hull 100 and an outrigger bridge assembly 160. The hull 100 is designed as a displacement hull: long, narrow, sleek and hollow in order to make it as lightweight as possible. In some preferred implementations, the hull 100 is made of carbon fiber, but in other implementations may include any combination of glass-reinforced plastic, polyester or epoxy resin, polyethylene or any other suitable material. On top of the hull 100 is a standing platform 110. The standing platform 110 is connected with the hull 100 preferably above the center of buoyancy, and can be formed as a lateral, mostly flat but slightly upward curving platform with a non-skid surface. On top of the hull 100 toward the rear is a hatch and cover 120 that allows access into the inside of the hull in order to make adjustments to the maneuvering assembly (see FIG. 4A).

The SUPO further includes one or more outrigger pontoons 130, and preferably two pontoons 130, that are connected to an outrigger bridge 140 by outrigger swivels 150. In preferred implementations, the outrigger pontoons 130 swivel freely for up to 180 degrees, from the three o'clock to nine o'clock position relative to the hull 100, but are held in the storage position, with the rear ends of the pontoons facing each other, using a ball plunger positioned at a longitudinal groove in the shaft, or by any other securement mechanism. The outrigger pontoons 130 are designed to swivel for easy storage; they can be turned parallel to the outrigger bridge 140 in order to take up less space, for example, when being stored in a canvas bag. Secondly, when making turns, the outrigger pontoons 130 will rotate to follow the stern during the turn thus reducing resistance to the fluid dynamics of the maneuver (see FIGS. 10A and 10B for detail). As with the hull 100, the outrigger pontoons 130 are designed as a displacement hull: sleek, long, narrow, and made as lightweight as possible.

Each outrigger bridge 140 attaches to the hull 100 with a bridge hinge 170 that has a removable ball lock pin 180. Since these parts will experience considerable stress, the outrigger bridge 140, bridge hinge 170, and outrigger swivels 150 can be made of stainless steel or aluminum alloy, or other resilient material such as carbon fiber, titanium or other suitable material. The top of the outrigger bridge 140 includes two adjustable tension spring assemblies 145. A rudder 190 is retractable backwards to take up less space when stored. Secondly, it will give way and not be damaged if an obstacle, such as the bottom of a body of water, rock/mud/sand or floating debris is encountered while in motion.

Figure 1B:
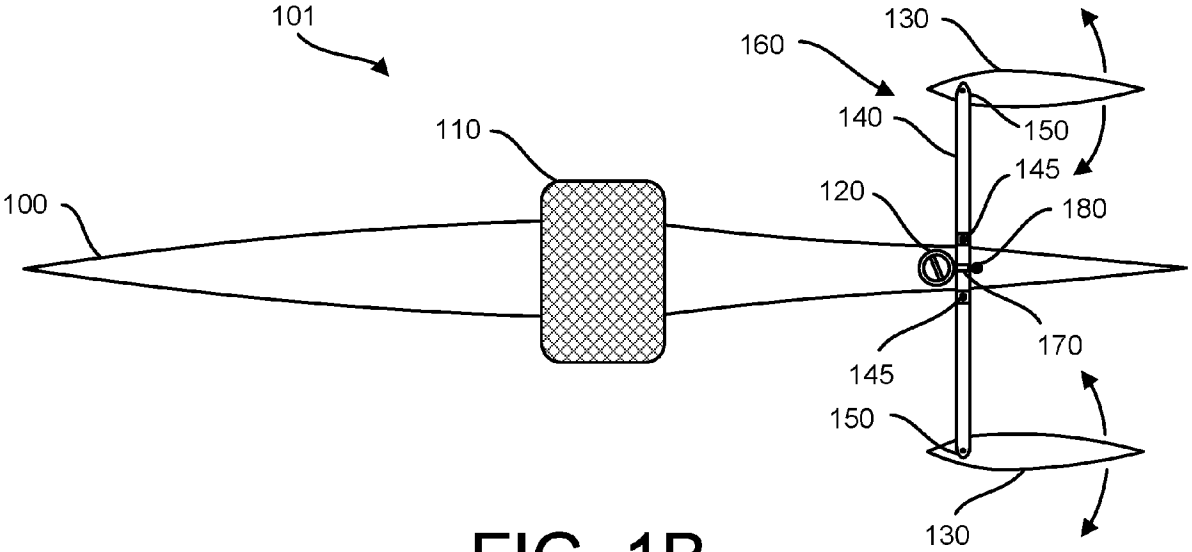
FIG. 1B shows a top view of the SUPO in the assembled, deployed position.

FIG. 1B illustrates a top view of the SUPO assembly 101 in the assembled, deployed position with the outrigger bridge assembly 160 in position on the hull 100 being held in place by the bridge hinge 170 and ball lock pin 180. All of the parts mentioned in FIG. 1A, with the exception of the rudder 190, which is hidden from view, are labeled in this diagram for cross-reference.

Figure 2:
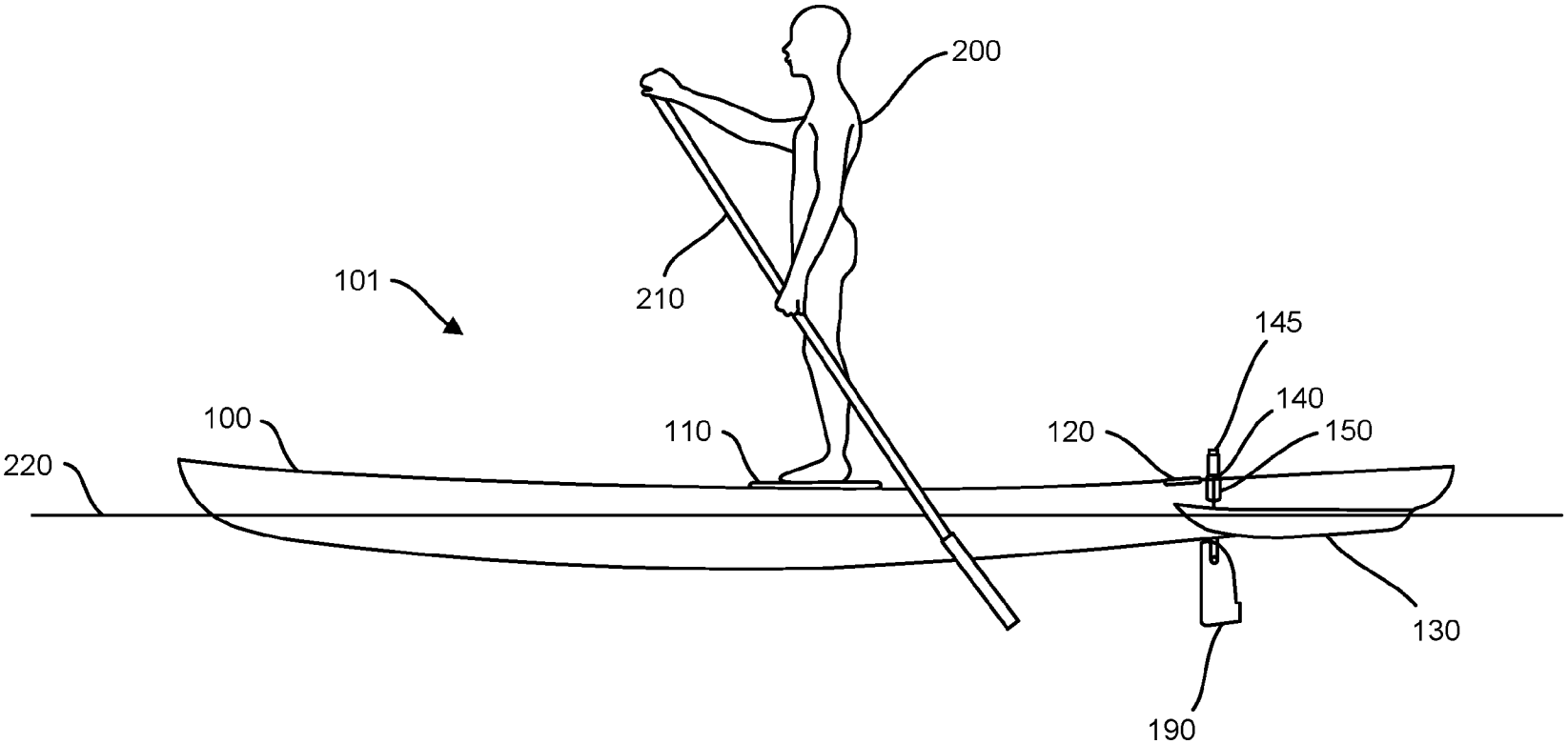
FIG. 2 shows a side view of a person paddling the SUPO. The rudder is shown in the deployed position.

FIG. 2 illustrates a person 200 in a normal paddling position standing on the standing platform 110. The person 200 is shown using a long handled paddle 210, such as the kind typically used with a SUP, to propel the craft through the water 220. A sail may also be used for propulsion, as described in further detail below. The rudder 190 is shown in the vertical, deployed position.

Figure 3A:
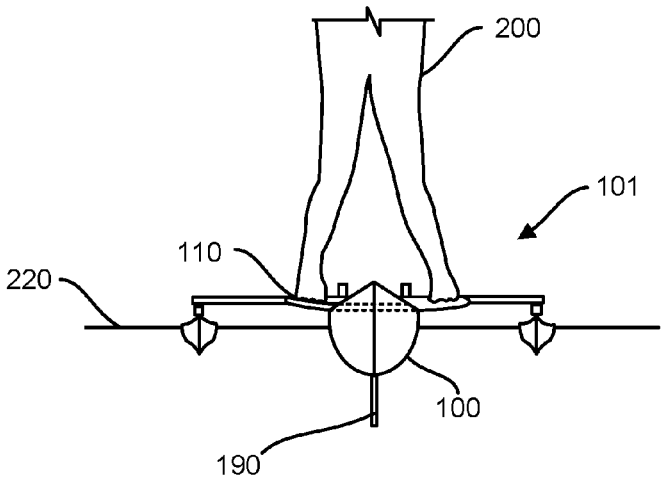
FIG. 3A shows the front view of a person on the SUPO with their body weight equally distributed between both feet.

FIG. 3A is a front view of the person 200 on the SUPO assembly 101 in the water 220. The person 200 is standing on the standing platform 110 with their body weight equally distributed laterally. This represents the centered position where the rudder 190 is held parallel to the centerline of the hull 100 in order to maintain a straight course when moving through the water 220.

Figure 3B:
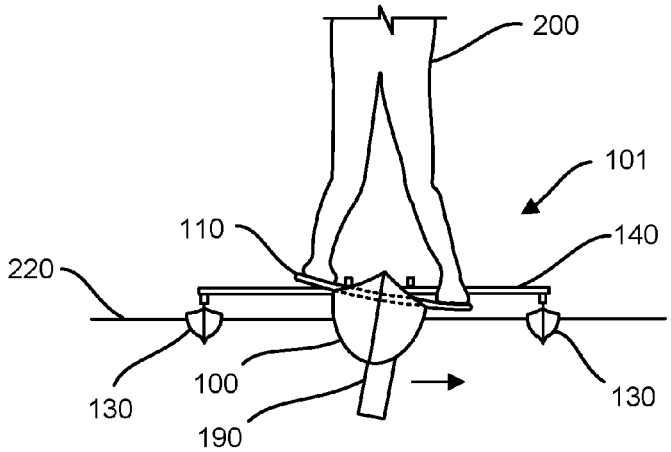
FIG. 3B shows the font view of a person on the SUPO with their body weight shifted to their left foot thereby turning the rudder to the left for a left turn.

FIG. 3B is the same view as in FIG. 3A, except that the person 200 has shifted their body weight to their left foot. This action pivots the hull 100 relative to the outrigger bridge 140 at the bridge hinge 170. The outrigger bridge 140 is held in a horizontal position by the floatation of the outrigger pontoons 130 as the hull 100 tilts beneath it to the left side of the craft. The difference in relative position of the hull 100 and outrigger bridge 140 is mechanically transferred to the rudderpost so that it is rotated to the left clockwise as viewed from above. The rudder 190 therefore moves to the left and causes a left turn when the craft is in motion.

Figure 3C:
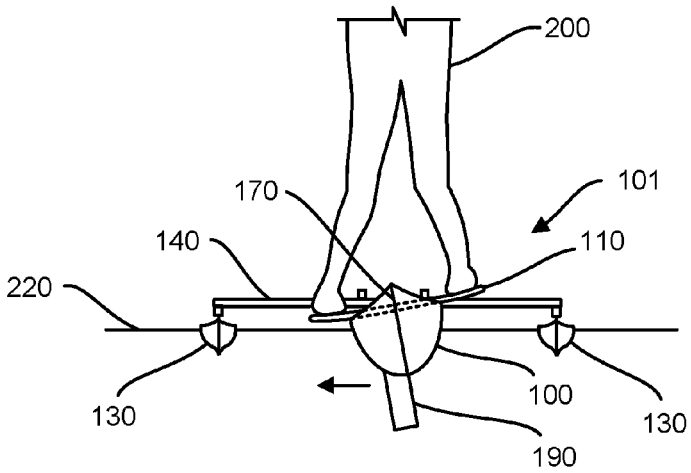
FIG. 3C shows the font view of a person on the SUPO with their body weight shifted to their right foot thereby turning the rudder to the right for a right turn.

FIG. 3C illustrates a SUPO as in FIG. 3A except that the person 200 has shifted their body weight to their right foot. This action pivots the hull 100 relative to the outrigger bridge 140 at the bridge hinge 170. The outrigger bridge 140 is held in a horizontal position by the floatation of the outrigger pontoons 130 as the hull 100 tilts beneath it to the right side of the craft. The difference in relative position of the hull 100 and outrigger bridge 140 is mechanically transferred to the rudderpost so that it is rotated to the right counterclockwise as viewed from above. The rudder 190 therefore moves to the right and causes a right turn when the craft is in motion.

Figure 4A:
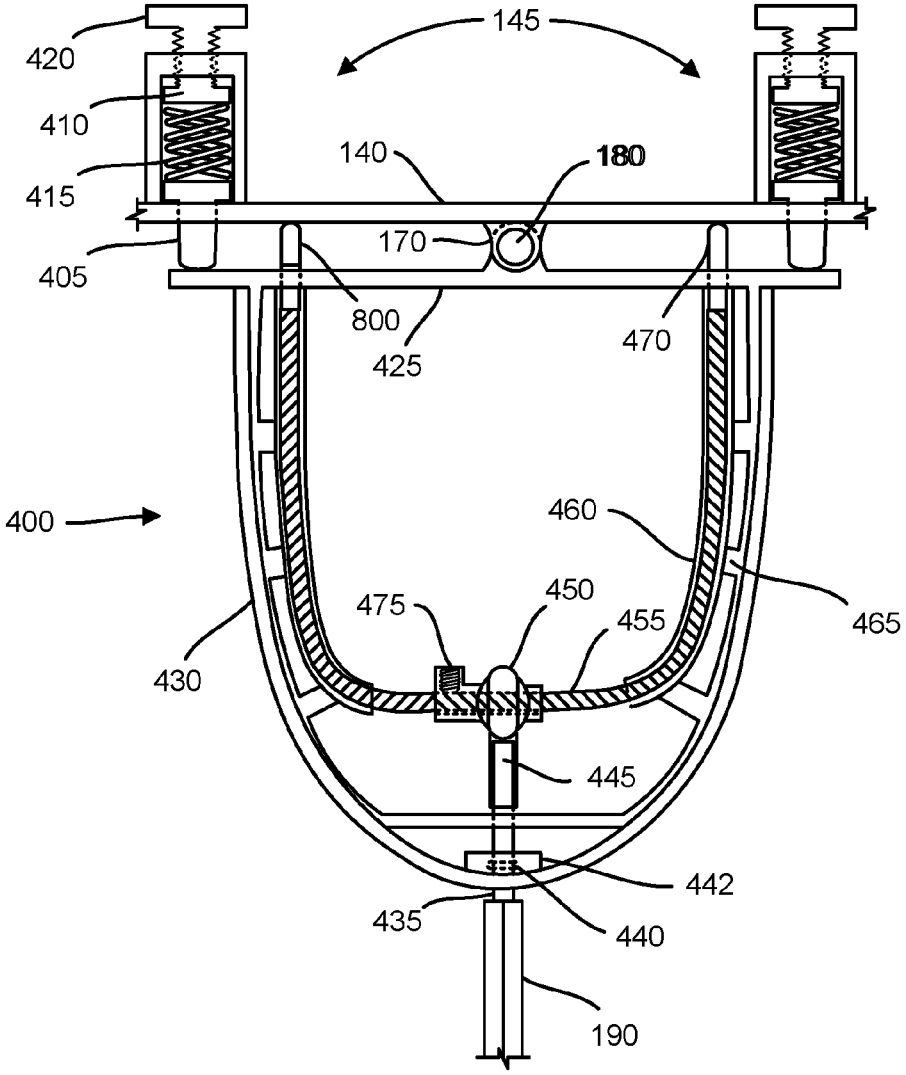
FIG. 4A is a rear, lateral, cross section view of below the outrigger bridge that shows the mechanics of the maneuvering assembly, which transfers the motion of tilt of the hull to rotation of the rudderpost. In this view, the rudder is centered because body weight is equally distributed.

FIG. 4A is a lateral, cross section view of a maneuvering assembly 400 from the rear. This view is from just below the outrigger bridge 140. On top of the outrigger bridge 140 are two tension spring assemblies 145 that serve to adjust the sensitivity of hull tilt response for different body weights or personal preference regarding firmer or more flexible turning action. The tension spring assembly 145 includes a movable piston 405 and an adjustable fixed piston 410 separated by a spring 415. The adjustable piston has a turning knob 420 for easy adjustment of spring tension; turning the knob clockwise or counterclockwise increases or decreases the tension.

Various mechanisms and techniques can be employed to provide a variable tension apparatus for the tension spring assembly 145. For instance, the tension spring assembly can use any number or combination of springs, coils, rubber bands, plyboard, or other suitable materials that can apply tension for this purpose. The bottoms of the movable pistons 405 can be slightly rounded and come in contact with the support bracket 425.

The support bracket 425 is rigidly attached to the inside of the hull shell 430 and serves as the primary mount and support for the entire maneuvering assembly 400, including a lower bridge hinge 170, rudder post 435, cable end caps 470/800 and cable sheath stanchion supports 465. The rudderpost 435 passes through the hull shell 430 and a through-hull flange 442, which has a rubber O-ring seal 440. Attached to the top of the rudderpost 435 is a rigid rudderpost flag 445 on which is mounted a ball rod end bearing 450. Passing through the ball rod end bearing 450 is a wire cable 455 that is guided by a sheath 460 that is fixed to the support bracket 425 with stanchions 465.

On the ends of the cable are cable end caps 470/800 to prevent the cable ends from fraying. One of the cable end caps is adjustable lengthwise 800 (see FIG. 8 for detail) in order to assure good contact between the cable end caps 470/800 and the outrigger bridge 140 so that there is no play or slop in the cable movement. The ends of the cable end caps 470/800 are rounded so that they slide easily on the underside of the outrigger bridge 140 as there will be a slight side-to-side movement. The two cable end caps 470/800 pass through the support bracket 425 to come in contact with the underside of the outrigger bridge 140. The cable 455 passes through the ball rod end bearing 450 and is held in place with a setscrew 475. There is sufficient space between the bottom ends of the left and right cable sheaths 460 to allow the ball rod end bearing 450 to move freely from side to side.

The hull 430 pivots laterally relative to the outrigger bridge 140 at the bridge hinge 170 with a removable ball lock pin 180 that holds the upper and lower parts of the hinge 170 together. As the hull 430 pivots from side to side, the cable 455 is pushed from side to side by the outrigger bridge 140 through the cable end caps 470/800, moving the ball rod end bearing 450 and rotating the rudderpost 435 and rudder 190. There are numerous mechanisms for transferring the relative motion between the hull 430 and the outrigger bridge 140 to the rotation of the rudderpost 435; however, in a preferred implementation a sheathed wire cable is used, as illustrated in the maneuvering assembly 400. Other implementations may include any combination of pushrods, gears, pulleys, and wire cable. All of the parts that make up the maneuvering assembly require a strong, corrosion resistant material; therefore these parts are preferably made of stainless steel. Alternatively, these parts can be formed of any combination of aluminum alloy, carbon fiber, plastics or other suitable materials.

Figure 4B:
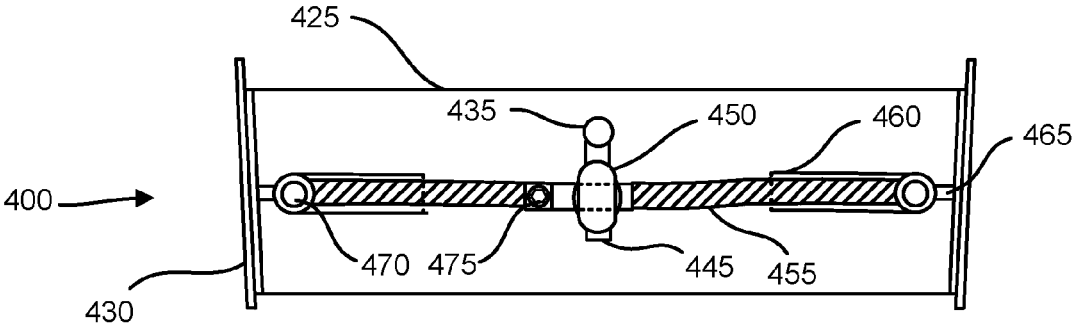
FIG. 4B is a top view of the maneuvering assembly.

FIG. 4B illustrates a top view of the bottom portion of the maneuvering assembly 400. Some parts listed in FIG. 4A are labeled for cross-reference.

Figure 5A:
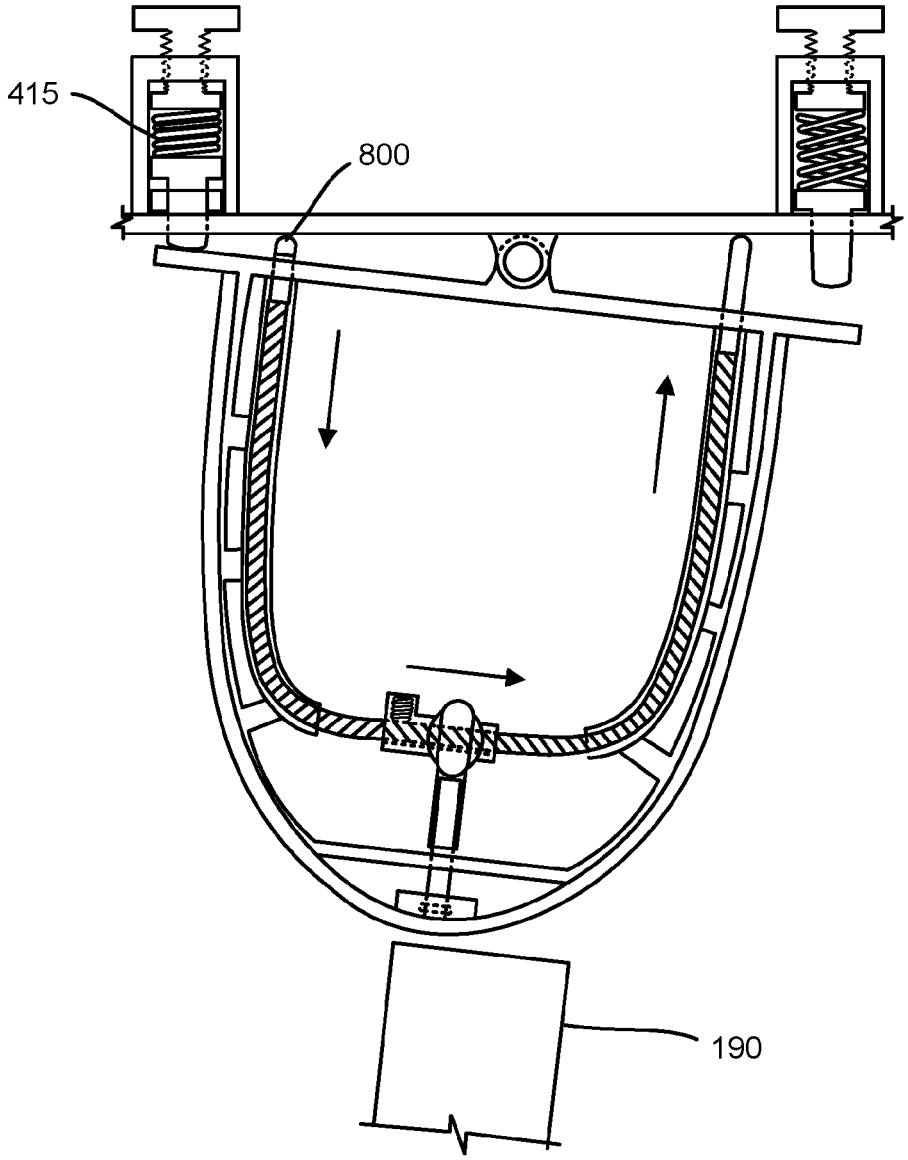
FIG. 5A is the same as FIG. 4A except that it shows the situation where body weight is shifted to the right foot thereby tilting the hull to the right and turning the rudder to the right for a right turn.
Figure 5B:
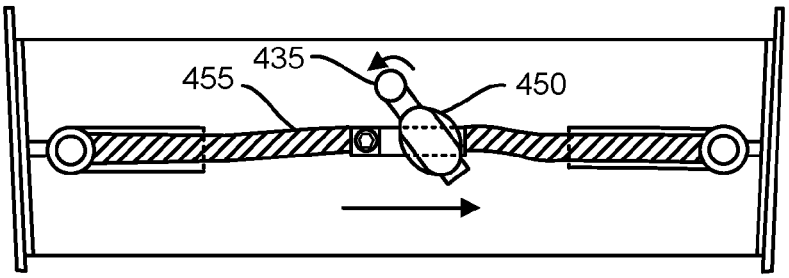
FIG. 5B is the same as 4B but in a right turn situation.

FIG. 5A shows an implementation that is similar to that shown in FIG. 4A except that it shows the hull tilted in a right turn position as a result of body weight being shifted to the right foot. Note that the left tension spring 415 is compressed and the left cable end cap 800 is pushed down shifting the rudder 190 to the right. FIG. 5B shows an implementation that is similar to that shown in FIG. 4B except that it shows a right turn situation as in FIG. 5A. Note that the cable 455 and ball rod end bearing 450 are shifted to the right thereby turning the rudderpost 435 counterclockwise.

Figure 6A:
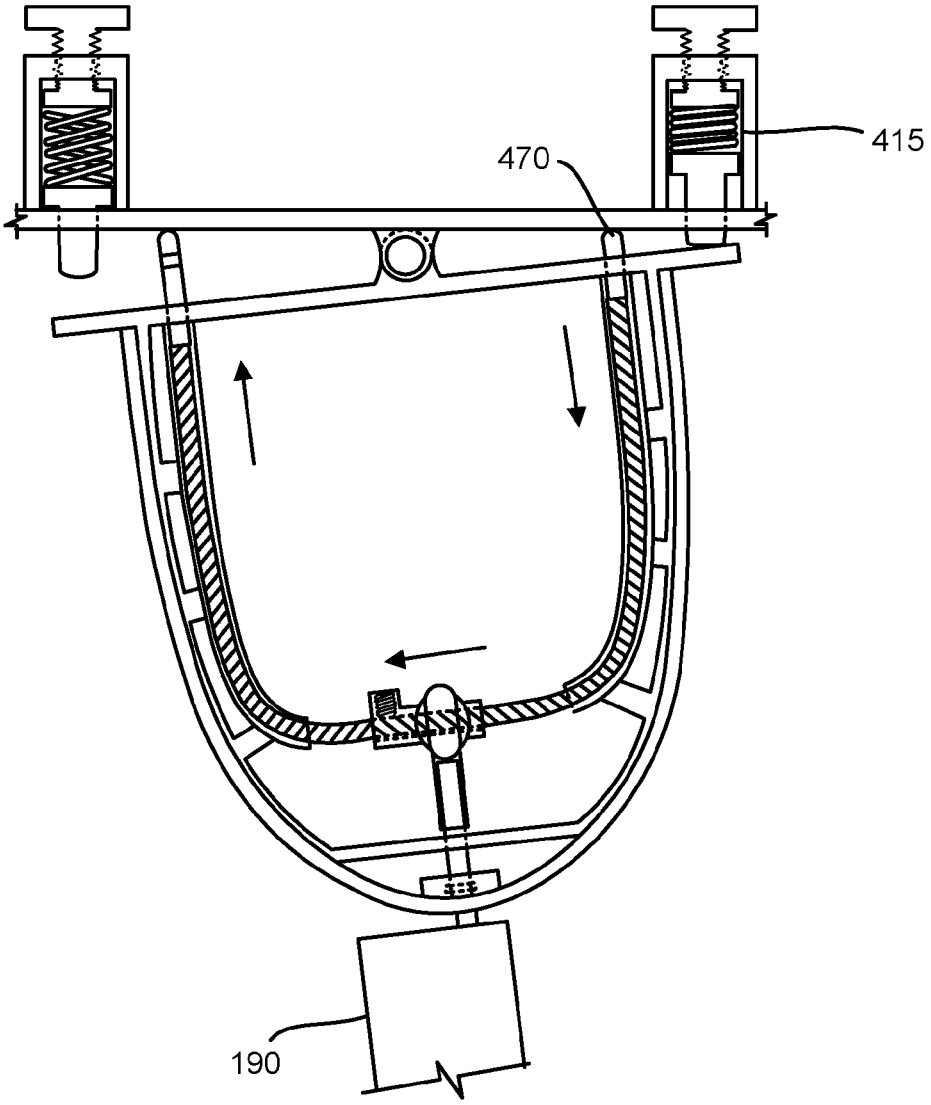
FIG. 6A is the same as FIG. 4A except that it shows the situation where body weight is shifted to the left foot thereby tilting the hull to the left and turning the rudder to the left for a left turn.
Figure 6B:
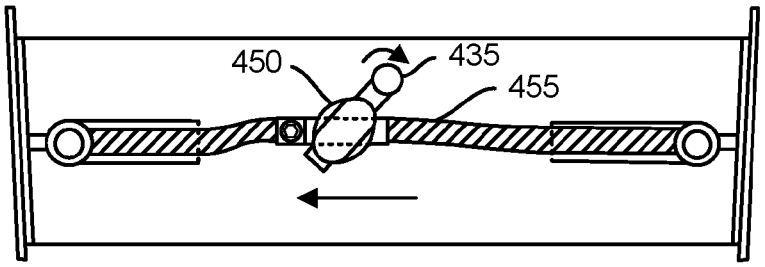
FIG. 6B is the same as 4B but in a left turn situation.

FIG. 6A shows an implementation that is similar to that shown in FIG. 4A except that it shows the hull tilted in a left turn position as a result of body weight being shifted to the left foot. Note that the right tension spring 415 is compressed and the right cable end cap 470 is pushed down shifting the rudder 190 to the left. FIG. 6B shows an implementation that is similar to that shown in FIG. 4B except that it shows a left turn situation as in FIG. 6A. Note that the cable 455 and ball rod end bearing 450 are shifted to the left thereby turning the rudderpost 435 clockwise.

Figures 7A, 7B:
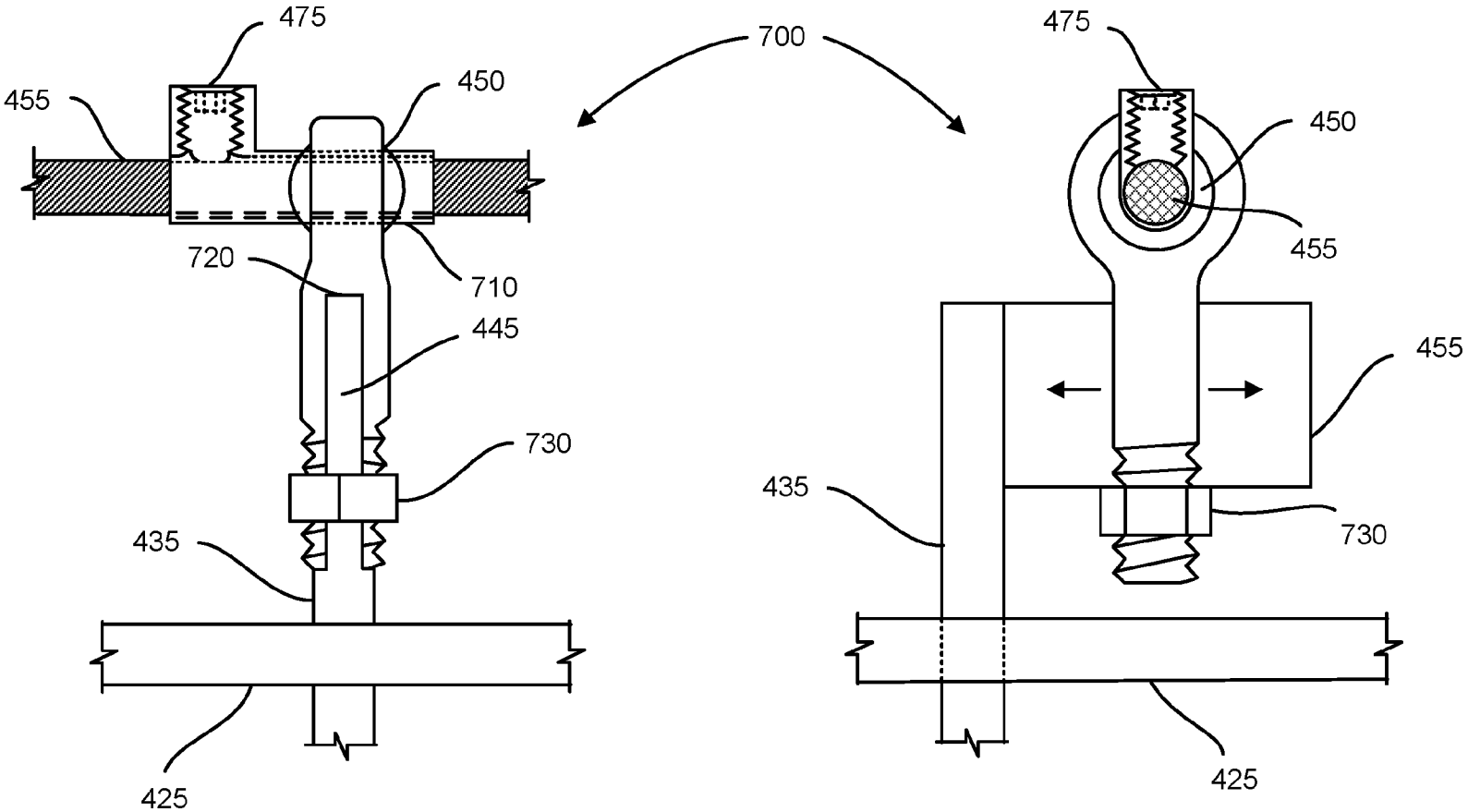
FIG. 7A shows a rear view of the mechanical details of the upper rudderpost assembly.
FIG. 7B shows a side view of the mechanical details of the upper rudderpost assembly.

FIG. 7A illustrates the rear view of the above-hull rudderpost assembly 700. Pressed into the ball of the ball rod end bearing 450 is a cable channel 710 with a setscrew 475 to hold the cable channel 710 and the ball rod end bearing 450 to the cable 455; the cable 455 passes through the cable channel 710 and is locked in place with the setscrew 475. There is a vertical through-slit 720 in the base and threads of the ball rod end bearing that allows it to slide back and forth over the rudderpost flag 445. At the base of the threads is a nyloc nut type lock nut 730.

FIG. 7B illustrates the side view of the above-hull rudderpost assembly 700 where it is easier to see how the ball rod end bearing 450 is able to slide back and forth along the rudderpost flag 445. Once the ball rod end bearing 450 is in the desired position, the lock nut 730 is tightened to hold it in place. This adjustment allows for fine-tuning the turning radius of the rudder's movement. Sliding the ball rod end bearing 450 toward the rudderpost 190 will increase the rotation of the rudderpost 190 while moving it farther away from the rudderpost 190 will decrease the rotation of the rudderpost 190. This allows the user to adjust to their personal preference a fine or coarse turning radius.

Figure 8:
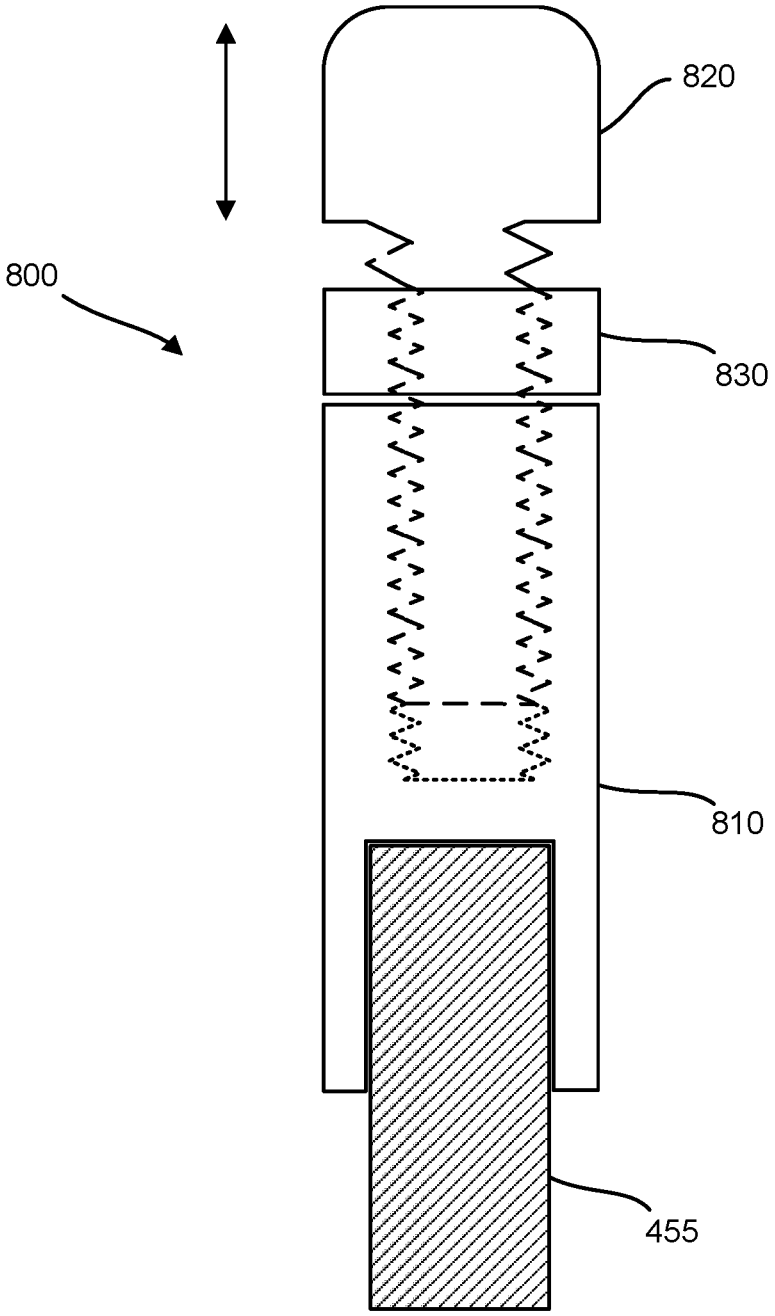
FIG. 8 shows a cross section view of the adjustable cable end cap.

FIG. 8 illustrates a side view cross section of the adjustable cable end cap assembly 800. The cable 455 is attached to one end of the base 810, using methods by those of ordinary skill in the art, and at the opposite end is a threaded opening to receive the threads of the head 820. On the threads of the head 820 is a lock nut 830. The length of the cable end cap assembly 800 can be increased or decreased by turning the head 820 clockwise or counterclockwise until the desired distance is obtained then tightening the lock nut 830 to hold it in place. This adjustment is used to eliminate any slop or play in the cable movement. There are numerous methods and techniques for addressing cable play in this situation, however the preferred embodiment of the invention uses a variable cable length adjustment as represented in the adjustable cable end cap assembly 800. Another embodiment of the invention may use an adjustment screw on the outrigger bridge 140, or other suitable method.

Figure 9A:
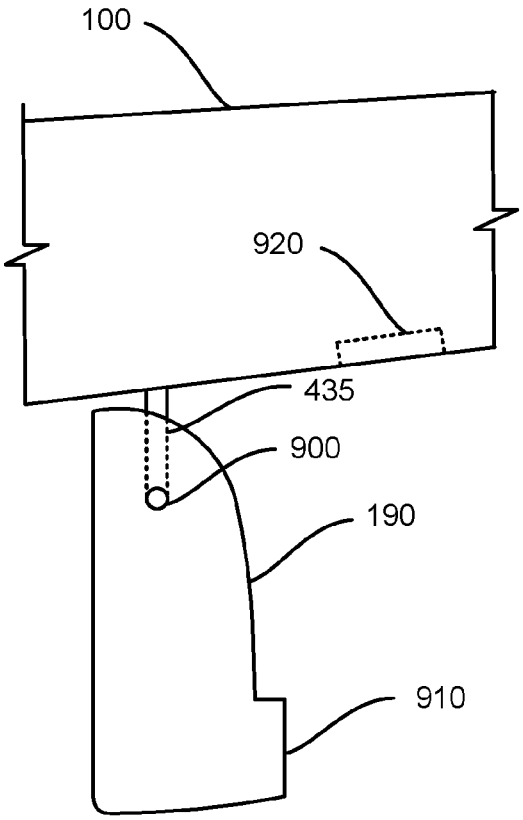
FIG. 9A shows a side view of the rudder in the deployed position.

FIG. 9A illustrates a side view of a section of the hull 100 and left side of the rudder 190. The rudder 190 is attached to the rudderpost 435 with a spring-loaded hinge 900 that holds the rudder 190 in the vertical position with sufficient force to overcome water resistance as it moves through the water. If the rudder 190 encounters an obstacle such as the bottom rock/mud/sand or floating debris, it will spring backwards to avoid damage or loss of speed. There are numerous methods and techniques for creating a spring loaded hinge for this purpose, in this case it will be fashioned by those of ordinary skill in the art. The lower rear section of the rudder 190 extends out 910 to provide a surface to be stowed in a receptacle 920 in the hull 100. The rudder is to made as strong yet lightweight as possible, therefore in the preferred embodiment of the invention, it is made of carbon fiber, but another embodiment of the invention may include glass-reinforced plastic, or polyester or epoxy resin, polyethylene or any other suitable material.

Figure 9B:
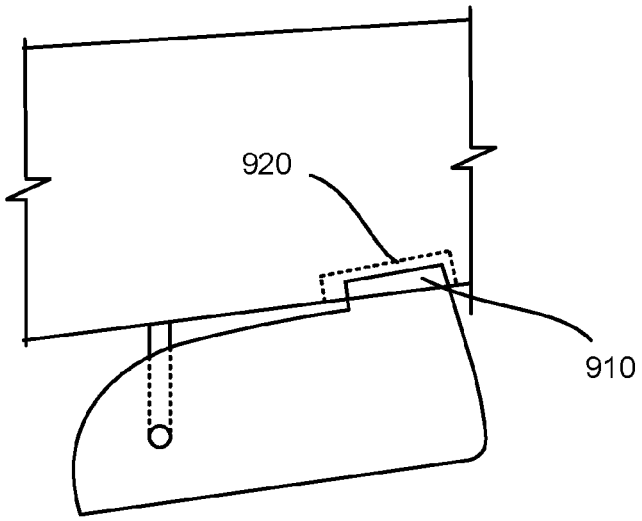
FIG. 9B shows a side view of the rudder in the stowed position.

FIG. 9B illustrates the same as 9A except that the rudder 190 is shown in the stowed position for storage. The rudder extension 910 fits snugly into a rubber hull receptacle 920, being pinched sufficiently with enough friction to hold the rudder 910 in this position. There are numerous methods and techniques for retracting the rudder 190 into the hull 100; the preferred embodiment of the invention is shown in this diagram. Another embodiment of the invention may have more or less of the rudder surface being retracted in the hull, or various kinds of locking devices to hold the rudder up instead of a pinching device using friction.

Figures 10A, 10B:
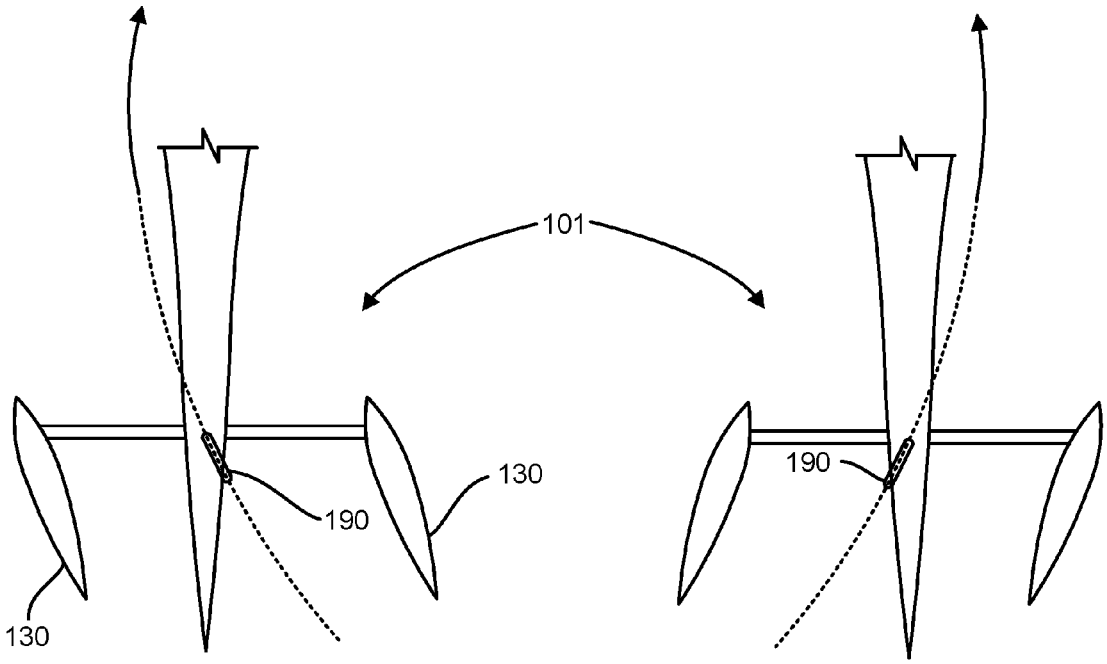
FIG. 10A shows a bottom view of the outrigger bridge assembly in a left turn situation.
FIG. 10B shows a bottom view of the outrigger bridge assembly in a right turn situation.

FIG. 10A illustrates a bottom view of the rear half of the SUPO assembly 101 in a left turn situation with the rudder 190 shifted to the left side of the craft. The outrigger pontoons 130 swivel to follow the turn thus reducing fluid dynamic resistance to the turning maneuver. Note that the inside pontoon turns outward thus increasing floatation and stability to the very side that body weight it being shifted.

FIG. 10B illustrates the same as FIG. 10A except that it shows a right turn situation with the rudder 190 shifted to the right of the craft.

Figure 11:
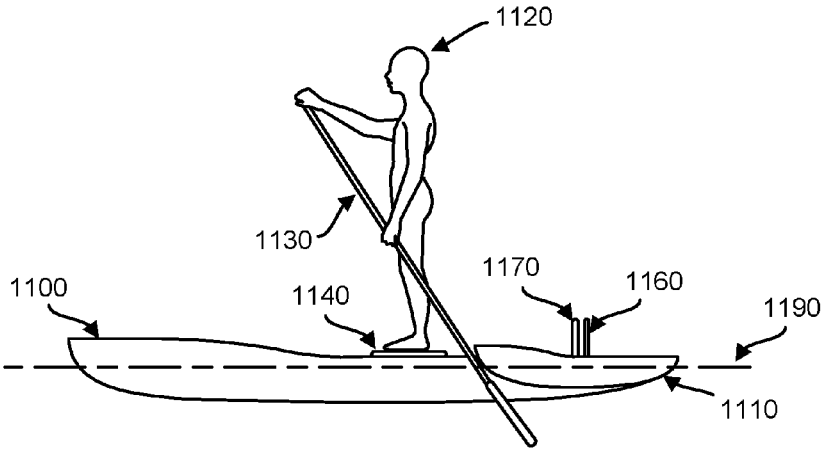
FIG. 11 shows a side view of a person paddling the SUPO.

FIG. 11 illustrates the side view of an average person 1120 paddling the SUPO using a paddle 1130. The person 1120 is standing on a standing platform 1140 which is mounted on top of the hull 1100, the main body of the craft. The hull 1100 is designed for displacement: long, narrow, sleek and as lightweight as possible. The hull 1100 is mostly submerged below the waterline 1190 but is buoyant enough to keep the person 1120 up and out of the water. In the preferred embodiment of the invention, it is to be made of carbon fiber, but another embodiment of the invention may include glass-reinforced plastic, or polyester or epoxy resin over a form core, polyethylene or any other suitable material. Those of ordinary skill in the art would produce the specific hydrodynamic design. Shown at the rear of the craft is the port pontoon 1110 which is held in place by the pontoon bridge 1170. Behind the pontoon bridge 1170 are tie rods 1160 which control the pontoons 1110 and keep them parallel to each other. The pontoon bridge 1170, and tie rods 1160 are made of a strong but lightweight material such as aluminum, but another embodiment of the invention may include materials such as carbon fiber, fiber glass, titanium, steel, or other plastics or metals.

Figure 12A:
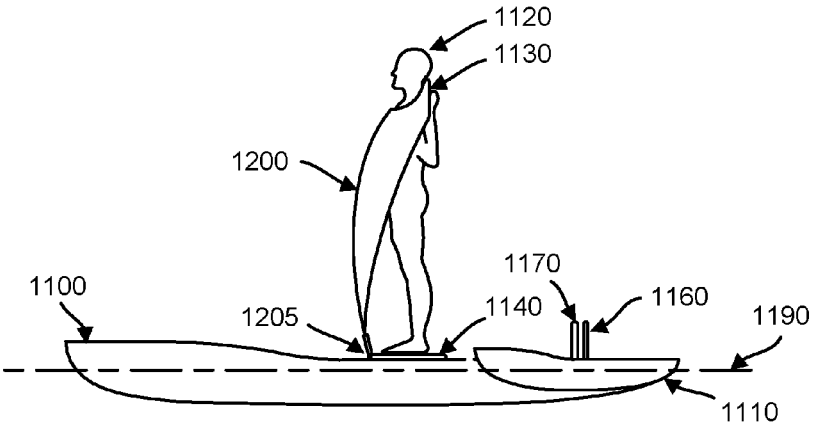
FIG. 12A shows a side view of a person sailing the SUPO.

FIG. 12A is a side view of a person 1120 sailing the SUPO using a sail 1200 that attaches to the paddle 130 which is held on the back of the shoulders. The bottom of the sail 1205 attaches to the front corners of the standing platform 1140.

Figure 12B:
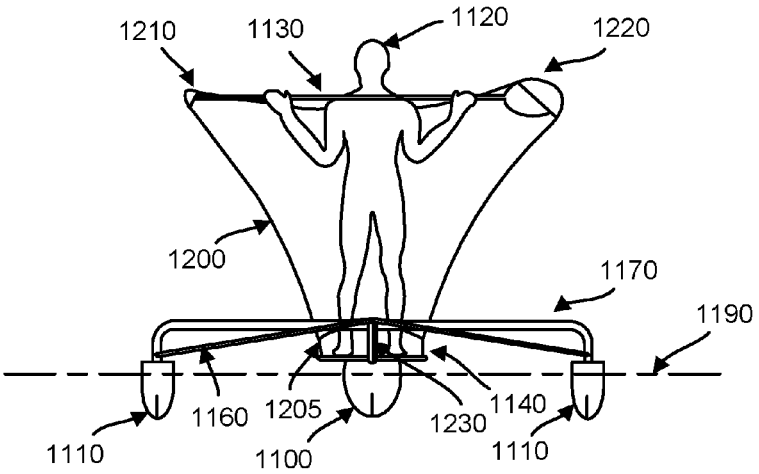
FIG. 12B shows a view from the rear of a person sailing the SUPO.

FIG. 12B illustrates a view from the rear of a person 1120 sailing the SUPO using the sail 1200. The sail 1200 attaches to the paddle 1130 at the upper two corners of the sail 1200 where there are pockets, one for the paddle handle 1210 and one for the paddle blade 1220. The bottom of the sail 1205 attaches to the front corners of the standing platform 1140. This attachment is adjustable in length for persons of different height.

Figure 13A:
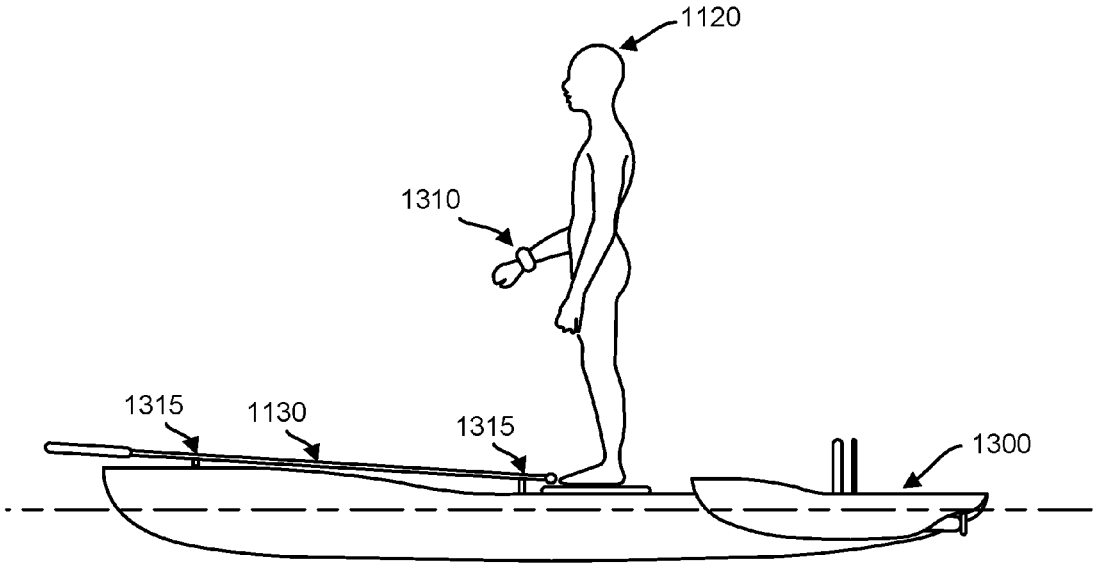
FIG. 13A shows a side view of a person motoring the SUPO.

FIG. 13A shows a side view of a person 1120 on the SUPO with motorized pontoons 1300 which are controlled speed/forward/reverse with a wireless remote control 1310. The remote control 1310 has a water sensor so that if the person 1120 falls into the water 1190, the propulsion mechanism 1320 is stopped. Since the paddle 1130 is not needed for propulsion, it is stored on deck and held there with paddle holders 1315.

Figure 13B:
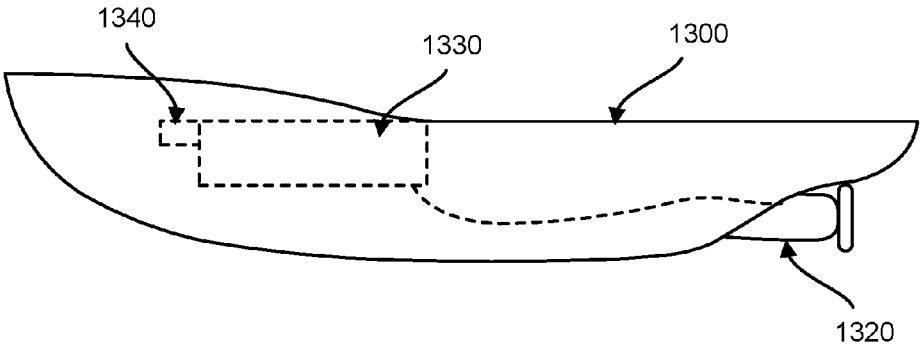
FIG. 13B shows a side view of the interchangeable motorized pontoon.

FIG. 13B shows a more detailed side view of a motorized pontoon 1300, these are interchangeable with the un-motorized pontoons used for paddling and sailing. Built into the pontoon 1300 is a propulsion mechanism 1320, a power supply 1330 and a controller 1340 which receives commands from the remote control 1310 and controls speed/forward/reverse the propulsion mechanism 1320. The preferred embodiment of the invention uses an electric motor driven propeller for the propulsion mechanism, but another embodiment may incorporate a jet drive or other system involving a pump.

Figure 14A:
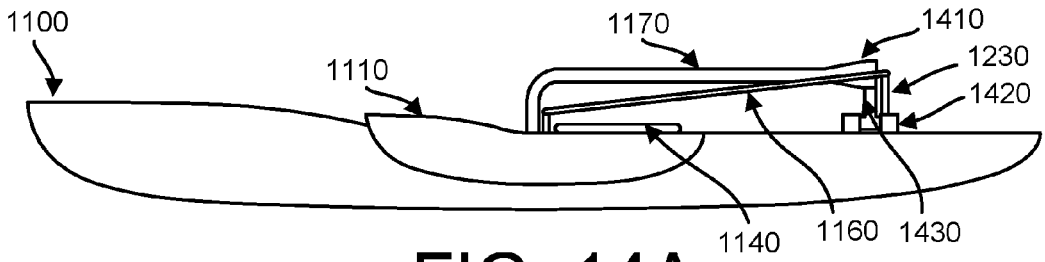
FIG. 14A shows a side view of the SUPO in the collapsed/stored position.

FIG. 14A shows a port side view of the SUPO in a collapsed position for storage and transportation. In this view, the pontoon bridge 1170 and pontoons 1110 are pivoted forward from the pontoon bridge stanchion 1430 in order to tuck under the standing platform 1140 and up against the hull 1100; this is to achieve a compact size. The tie rods 1160 also pivot forward from the tie rod stanchion 1230 and remain parallel to the pontoon bridge 1170 keeping the pontoons 1110 parallel to each other. The pontoon bridge stanchion 1430 has a vertical hinge at the top, the pontoon bridge hinge 1410, and a horizontal hinge at the bottom, the hull pivot hinge 1420, which is attached to the hull 1100.

Figure 14B:
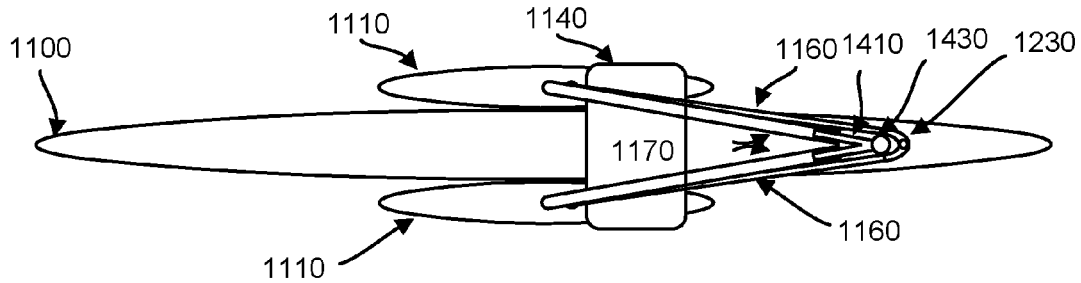
FIG. 14B shows a top view of the SUPO in the collapsed/stored position.

FIG. 14B shows a top view of the SUPO in a collapsed position for storage and transportation. The same description in FIG. 14A applies to this view.

Figure 14C:
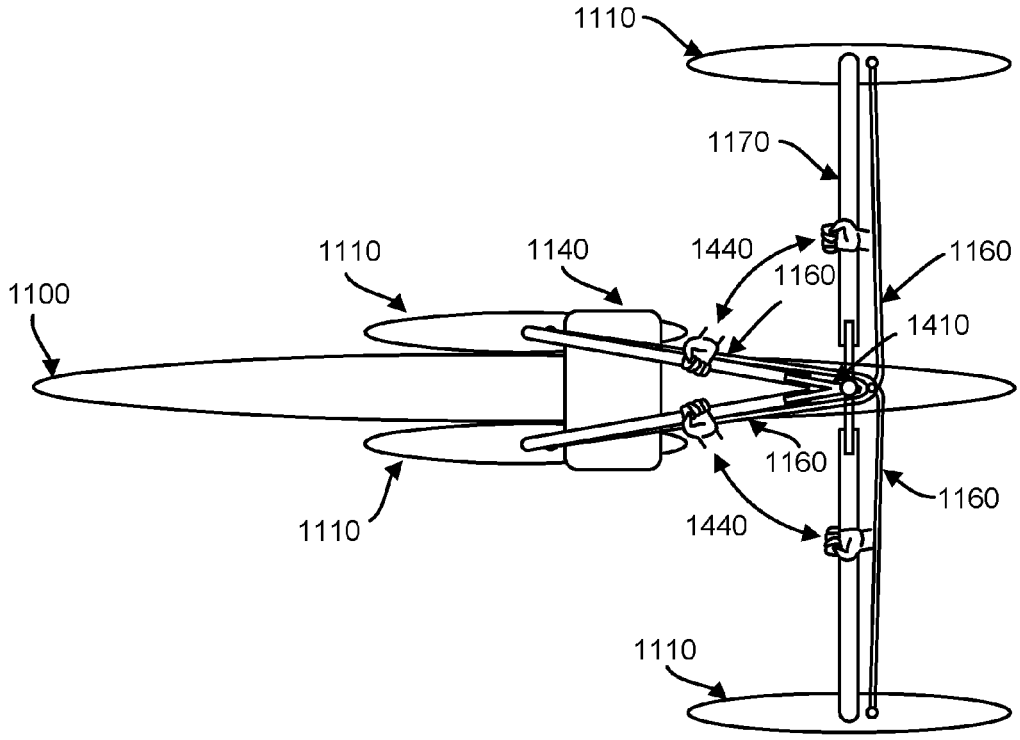
FIG. 14C shows a top view of the SUPO indicating how the pontoons pivot out to the operating position.

FIG. 14C shows a top view of the SUPO in the collapsed and deployed positions indicating the transition between the two. The pontoons 1110 would be moved into the deployed position by hand 1440, by moving the two halves of the pontoon bridge 1170 back until the pontoon bridge hinge 1410 locks them into a position perpendicular to the hull 1100.

Figure 15A:
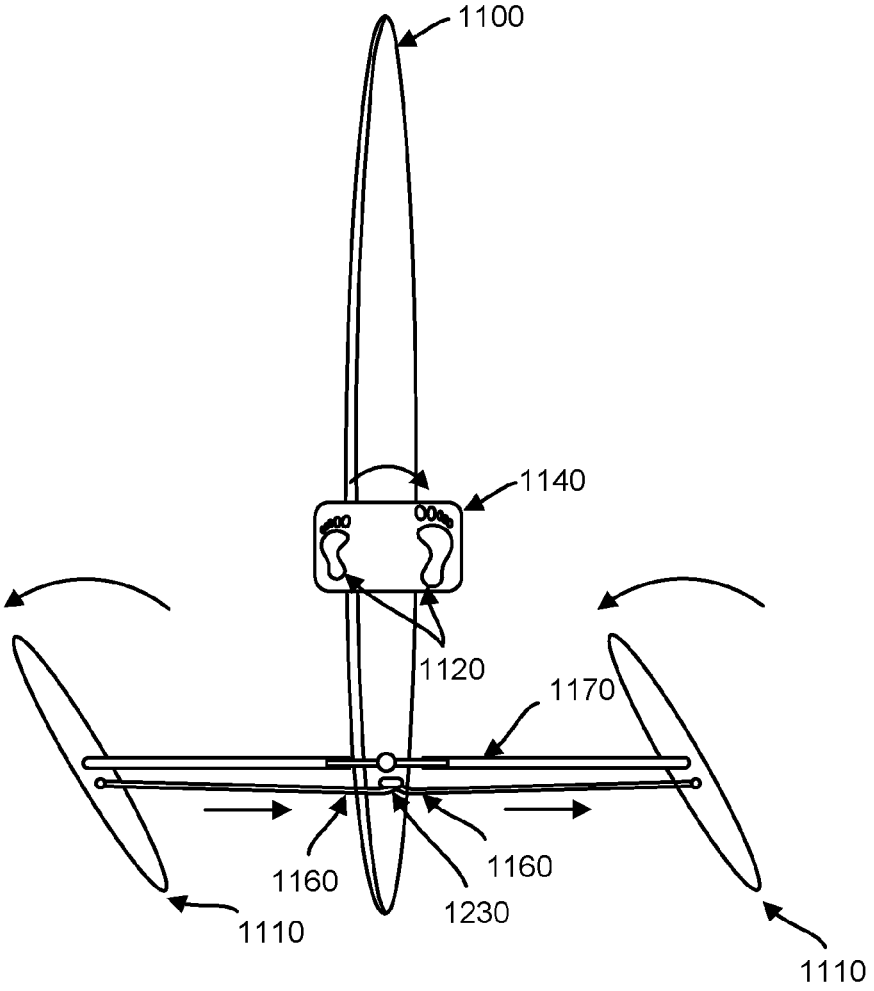
FIG. 15A shows a top view of the SUPO indicating how a right turn is made.

FIG. 15A shows a top view of the SUPO in a turn to starboard. As the person 1120 on the standing platform shifts their body weight to their right foot, the hull 1100 rotates clockwise, as viewed from the rear, and this tilts the tie rod stanchion 1230 to the right. This also moves the tie rods 1160 to the right which moves the pontoons 1110 in a counterclockwise direction. The pontoons 1110 serve as rudders and this turns the craft to the right.

Figure 15B:
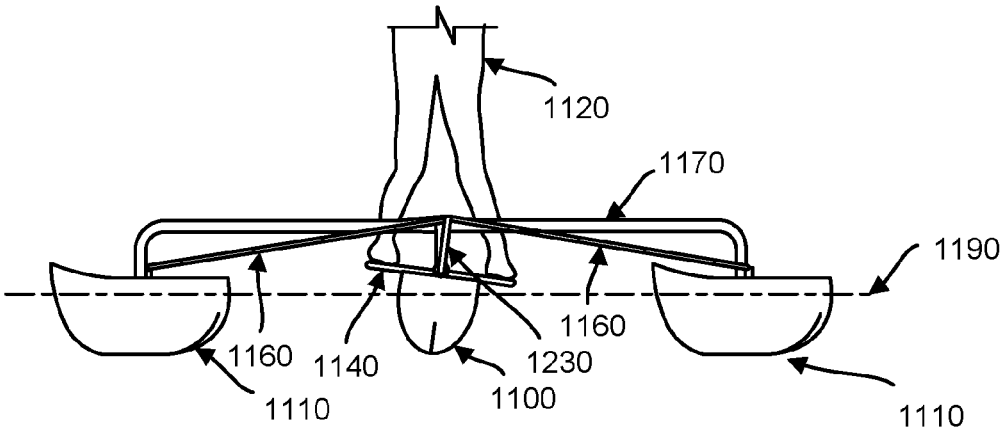
FIG. 15B shows a view from the rear of the SUPO indicating how a right turn is made.

FIG. 15B shows a view from the rear of the SUPO in a turn to starboard. The same description in FIG. 15A applies to this view.

Figure 16A:
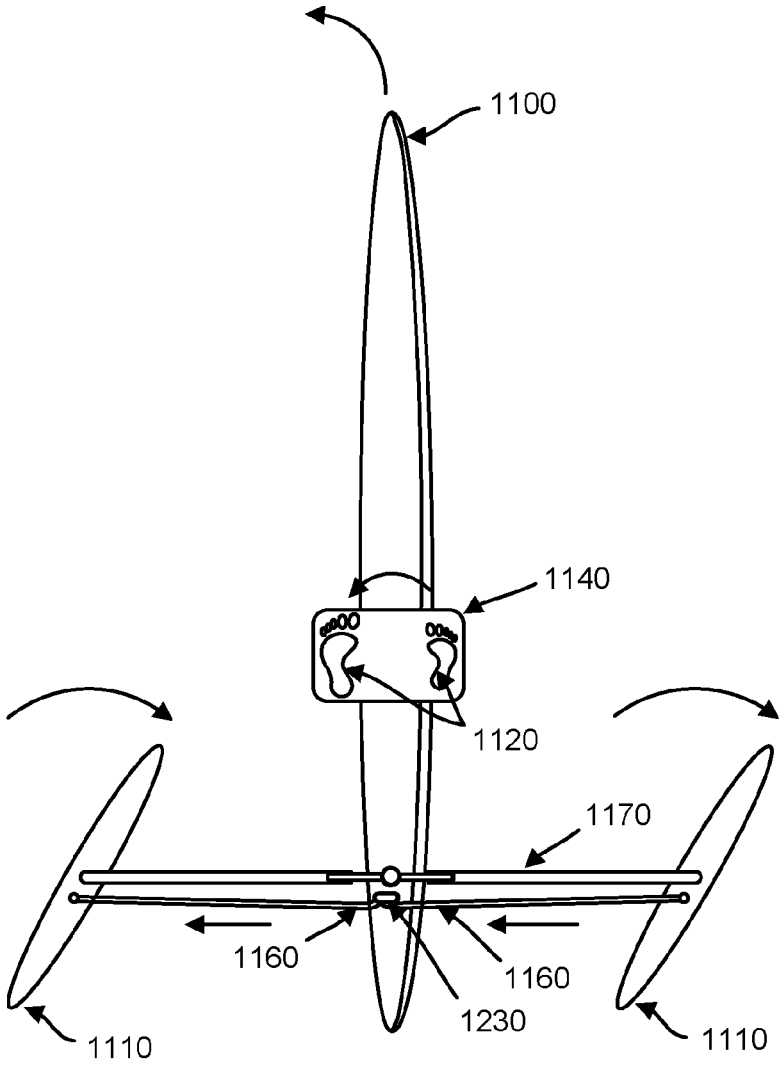
FIG. 16A shows a top view of the SUPO indicating how a left turn is made.

FIG. 16A shows a top view of the SUPO in a turn to port. As the person 1120 on the standing platform shifts their body weight to their left foot, the hull 1100 rotates counterclockwise, as viewed from the rear, and this tilts the tie rod stanchion 1230 to the left. This also moves the tie rods 1160 to the left which moves the pontoons 1110 in a clockwise direction. The pontoons 1110 serve as rudders and this turns the craft to the left.

Figure 16B:
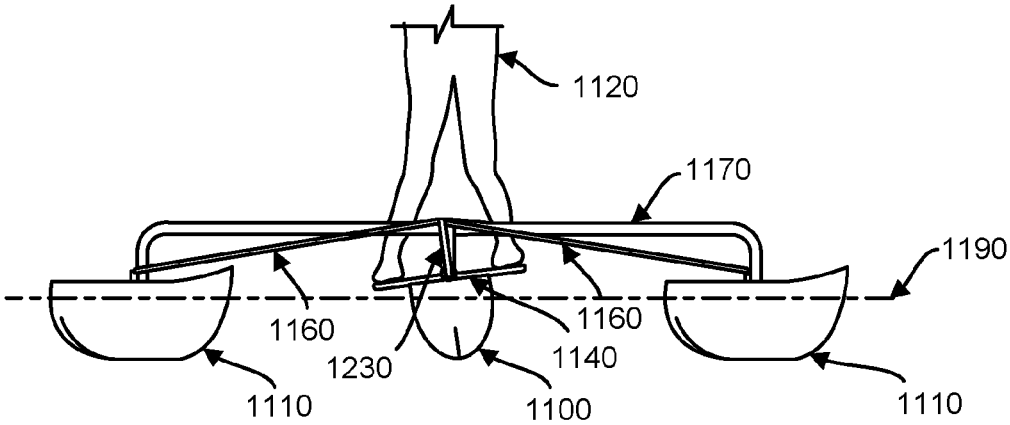
FIG. 16B shows a view from the rear of the SUPO indicating how a left turn is made.

FIG. 16B shows a view from the rear of the SUPO in a turn to port. The same description in FIG. 16A applies to this view.

Figure 17A:
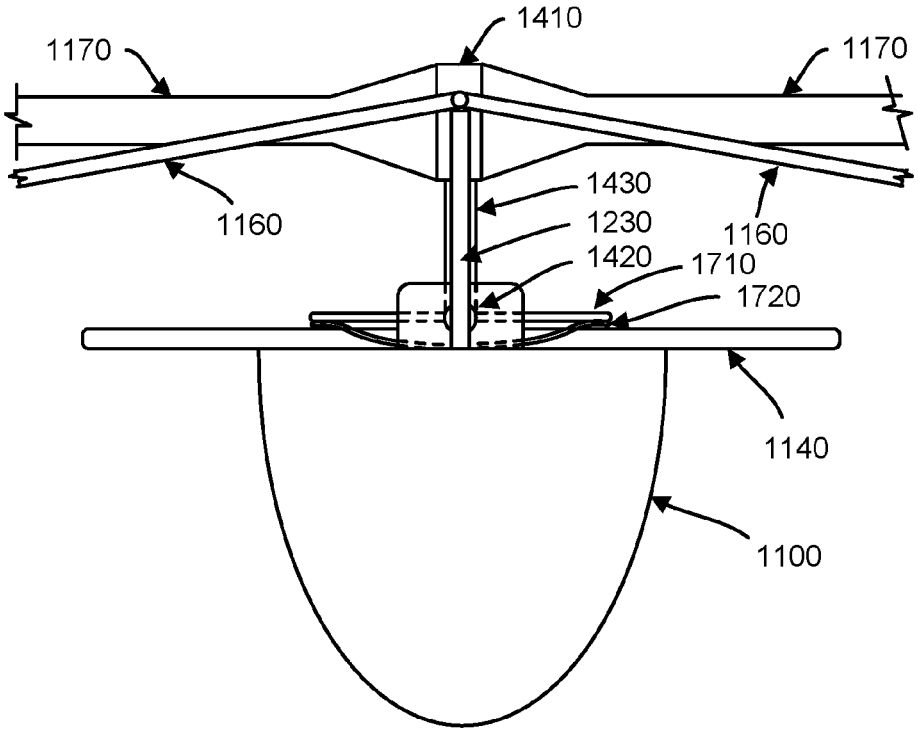
FIG. 17A shows a view from the rear of the outrigger turning mechanism in the neutral position.

FIG. 17A shows a more detailed illustration of the outrigger turning mechanism from the rear of the craft. The two halves of the pontoon bridge 1170 are connected together in the middle with the pontoon bridge hinge 1410, this is a vertical hinge which is mounted to the top of the pontoon bridge stanchion 1430. This hinge allows the two halves of the pontoon bridge 1170 to pivot horizontally. The bottom of the pontoon bridge stanchion 1430 is connected directly to the hull 1100 with the hull pivot hinge 1420, a horizontal hinge that allows the hull 1100 to pivot longitudinally while the pontoon bridge 1170 is held in a constant horizontal position by the pontoons. On either side of the pontoon bridge stanchion 1430 are arms 1710 which come in contact with a leaf spring 1720 that is connected to the hull 1100. The leaf spring 1720 applies constant pressure to the arms 1710 in order to hold the pontoon bridge stanchion 1430 in a vertical position. This is to maintain a default pontoon position which is in a straight alignment with the hull resulting in a straight heading with no turning while moving through the water.

Figure 17B:
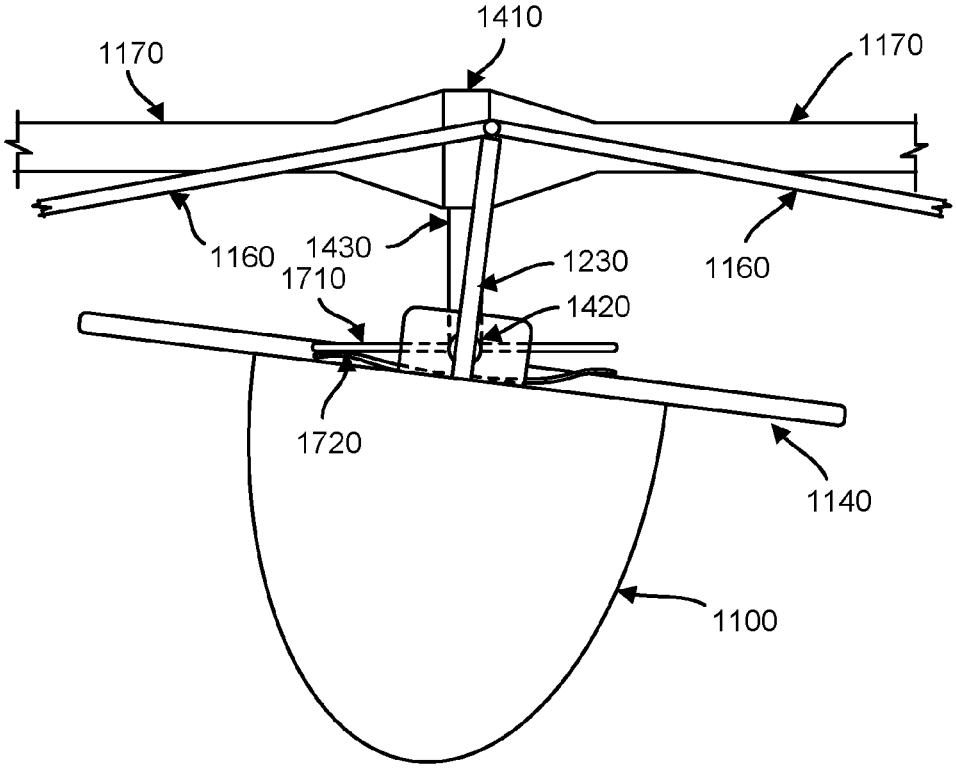
FIG. 17B shows a view from the rear of the outrigger turning mechanism in right turning position the left turn position would be a mirror image of this illustration.

FIG. 17B is the same illustration as FIG. 17A except that it shows the outrigger turning mechanism in a starboard turn situation where body weight has been shifted to the right foot. The shift in weight on the standing platform 1140 has rotated the hull 1100 clockwise and this has tilted the top of the tie rod stanchion 1230 to the right. The pontoons maintain the pontoon bridge 1170 in a horizontal position so the result is a difference in position between the pontoon bridge stanchion 1430 and the tie rod stanchion 1230, and this moves the tie rods 1160 to the right causing the pontoons to pivot. The leaf spring 1720 beneath the left/portside arm 1710 gives under pressure but provides enough resistance/stiffness so that the hull 1100 does not pivot back and forth too easily, thereby preventing too much motion and instability. Another embodiment of the invention may use a configuration of coiled springs for this purpose.

This is a description of the preferred embodiment of the invention but another embodiment of the invention may include methods and techniques in the design that use any combination of pushrods, gears, pulleys, and wire cable in order to achieve maneuverability of a stand up paddle craft by shifting body weight. All of the parts that make up the maneuvering assembly require a strong, corrosion resistant material; therefore, the preferred embodiment of the invention has these parts made of stainless steel and aluminum alloy. Another embodiment of the invention may use carbon fiber, plastics or other suitable materials for these parts.

Although a few embodiments have been described in detail above, other modifications are possible. Other embodiments may be within the scope of the following claims.

The invention claimed is:

1. A watercraft comprising:

an elongated displacement hull;

a pair of outrigger pontoons, each of the outrigger pontoons being mounted to the displacement hull by a bridge;

a platform mounted on a top of the displacement hull forward of the pair of outrigger pontoons; and a rudder mounted to a rear of the displacement hull and to the bridges connected with the pair of outrigger pontoons;

the rudder and the pair of outrigger pontoons being steerable in a common direction based on a weight of a rider that is applied to one side or another of the platform.

* * * * *